US007021734B2

(12) United States Patent
Lee

(10) Patent No.: US 7,021,734 B2
(45) Date of Patent: Apr. 4, 2006

(54) INKJET PRINTER AND PRINTING SYSTEM THEREOF AND METHOD OF COMPENSATING FOR DETERIORATED NOZZLE

(75) Inventor: Seung-don Lee, Sungnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/345,939

(22) Filed: Jan. 17, 2003

(65) Prior Publication Data

US 2003/0142158 A1 Jul. 31, 2003

(30) Foreign Application Priority Data

Jan. 31, 2002 (KR) ..... 2002-5696

(51) Int. Cl.
*B41J 29/38* (2006.01)
*B41J 29/393* (2006.01)

(52) U.S. Cl. ..... 347/12; 347/19

(58) Field of Classification Search ..... 347/12, 347/14, 19, 41; 400/124.07, 74
See application file for complete search history.

(56) References Cited

U.S. PATENT DOCUMENTS

| | | | | |
|---|---|---|---|---|
| 4,907,013 | A * | 3/1990 | Hubbard et al. | 347/19 |
| 5,650,808 | A * | 7/1997 | Vincent et al. | 347/43 |
| 6,199,969 | B1 * | 3/2001 | Haflinger et al. | 347/19 |
| 6,278,469 | B1 * | 8/2001 | Bland et al. | 347/19 |
| 6,312,098 | B1 * | 11/2001 | Miquel et al. | 347/41 |
| 2002/0070993 | A1 * | 6/2002 | Mantell | 347/19 |

FOREIGN PATENT DOCUMENTS

| | | |
|---|---|---|
| KR | 1998-040823 | 8/1998 |
| KR | 1999-010870 | 3/1999 |
| KR | 1999-020082 | 3/1999 |
| KR | 1999-0038206 | 6/1999 |
| KR | 1999-0058137 | 7/1999 |

* cited by examiner

*Primary Examiner*—Thinh Nguyen
(74) *Attorney, Agent, or Firm*—Staas & Halsey LLP

(57) ABSTRACT

An inkjet printer, a system thereof and a method of compensating for deteriorated nozzles. The inkjet printer has an input unit to select a printing workload share for nozzle groups with respect to an image writing unit area, each nozzle group including a plurality of nozzles; and a control unit to control the print head according to the printing workload share selected by the input unit, thereby causing the image data to be printed onto the recording medium. Since the printing workload share for the defective nozzles is reduced, print quality deterioration can be prevented without having to replace a print head.

25 Claims, 12 Drawing Sheets

INKJET PRINTER AND PRINTING SYSTEM THEREOF AND METHOD OF COMPENSATING FOR DETERIORATED NOZZLE

CROSS-REFERENCE TO RELATED APPLICATIONS

This application claims the benefit of Korean Application No. 2002-5696, filed Jan. 31, 2002, in the Korean Intellectual Property Office, the disclosure of which is incorporated herein by reference.

BACKGROUND OF THE INVENTION

1. Field of the Invention

The present invention relates to an inkjet printer and a printing system, and a method of compensating for nozzle deterioration, and more particularly, to an inkjet printer and a printing system capable of preventing print quality deterioration due to defective nozzles by varying a printing workload share for each nozzle group, and a method of compensating for the nozzle deterioration.

2. Description of the Related Art

A printer prints print data onto a recording medium such as a paper. Inkjet type, laser type and thermal type printers are commonly available types of printers. An inkjet printer prints an image on a paper while a print head moves across an advancing direction of the paper, ejecting ink through nozzles. For higher printing speed and resolution, nozzles are formed on the print head of the inkjet printer in an increasing number.

FIGS. 1A and 1B show an example of nozzle arrangements, in which the nozzles 13 and 15 are arrayed on print heads 10 and 14 of the color inkjet printer. Characters 'Y,' 'M,' 'C,' and 'K' in the drawings respectively indicate nozzles through which ink of the colors Yellow, Magenta, Cyan, and Black, is respectively ejected.

In such an inkjet printing type printer, a size and ejecting direction of the ink droplet becomes different from the desired values during the manufacturing process and/or as time goes by. As a result, the image is incomplete due to defective nozzles, and does not meet the requirements of a user. This is especially true when the print head is driven to have one nozzle print one line. In such a case, line printed by the defective nozzle is more noticeably distorted.

In an attempt to deal with such deterioration of print quality due to defective nozzles, a Shingling approach has been suggested. According to the Shingling approach, the print head is driven to spread out the image which is printed by the defective nozzles. Also, according to the Shingling approach, the nozzles of identical numbers are grouped into a plurality of nozzle groups, each printing the same amount. This approach, however, has a shortcoming. That is, because the same amount of the printing workload is assigned to each nozzle group, each of which has the same number of nozzles, print quality deterioration cannot be properly dealt with when there are different numbers of defective nozzles in the nozzle groups.

SUMMARY OF THE INVENTION

Accordingly, it is an object of the present invention to overcome the above-mentioned problems of the prior art.

It is another object of the present invention to provide an inkjet printer and a printing system to prevent print quality deterioration by adjusting the share of the printing workload assigned to each nozzle group according to the number of defective nozzles in each nozzle group, and a method of compensating for the deteriorated nozzles.

Additional objects and advantages of the invention will be set forth in part in the description which follows and, in part, will be obvious from the description, or may be learned by practice of the invention.

The foregoing and other objects of the present invention are accomplished by providing an inkjet printer to print image data on an image writing unit area of a recording medium, the inkjet printer including a print head having a plurality of nozzles arrayed in nozzle groups to jet ink therethrough; an input unit to select a printing workload share for each of the nozzle groups with respect to the image writing unit area, the nozzle groups including a number of the plurality of the nozzles; and a control unit to control the print head according to the printing workload share selected by the input unit, thereby causing the image data to be printed onto the recording medium.

The input unit may be provided with a key to select the share of the printing workload, and when the key is selected, the control unit displays a printing workload share selection menu on a display device, to select the printing workload share through a manipulation of the input unit.

The printing workload share selection menu provides selections of 12%, 17%, 25%, 38% and 50% for the printing workload share of the nozzle groups.

The control unit may be provided with a masking table of each printing workload share. The masking table corresponds to information about a printing position where the nozzles of the nozzle groups selectively perform a printing operation with respect to the predetermined image writing unit area. The control unit controls the driving of the nozzles to print print data while applying the masking table that corresponds to the selected printing workload share for each nozzle group.

Each nozzle group may include plural nozzles that are arrayed in a row in an advancing direction of the recording medium, the nozzles being spaced from each other in the advancing direction of the recording medium by a predetermined distance.

The foregoing and other objects of the present invention may also be achieved by providing an inkjet printer to print image data on an image writing unit area of a recording medium, the inkjet printer including a print head having a plurality of nozzles arrayed in nozzle groups to jet ink therethrough; an input unit including a printing workload share adjusting mode key to inquire about a presence of a defective one of the nozzles in the nozzle groups and to adjust a printing workload share for the nozzle groups according to a checking result in the image writing unit area; a nozzle state analyzing unit to analyze the defective one of the nozzles; and a control unit to control the nozzle state analyzing unit to analyze the presence of the defective nozzle when the printing workload share adjusting mode key is selected, the control unit to adjust the printing workload share of the nozzle groups so that a one of the nozzle groups having a greater number of the defective nozzles has a lower printing workload share than another one of the nozzle groups in regard to the image writing unit area, the control unit to control the print head according to the adjusted printing workload share when the image data is printed on the recording medium.

The control unit may adjust the printing workload share of each of the nozzle groups by analyzing the information about the state of the nozzle which is output from the nozzle state analyzing unit, such that a nozzle group having the most defective nozzles has a lower printing workload share than another nozzle group having the least defective nozzles.

The foregoing and other objects of the present invention may also be accomplished by providing an inkjet printing system including a print head having a plurality of nozzles arranged in groups to jet ink therethrough, an inkjet printer that prints image data onto a recording medium by controlling the print head; and a computer connected to the ink jet printer, the computer including a printer driver to provide a menu to variably select a printing workload share for each of the nozzle groups, and to transmit the information about the selected printing workload share of the nozzle groups to the inkjet printer such that the print head is driven according to the selected printing workload share.

The printer driver may be recorded onto the recording medium to be read and thereby executed by the computer.

The foregoing and other objects of the present invention may also be accomplished by providing a method of compensating for deteriorated nozzles of an inkjet printer, including inquiring about a presence of defectiveness in a plurality of nozzles that jet an ink therethrough, the nozzles arranged in nozzle groups; determining a printing workload share for each of the nozzle groups according to the inquiring; and printing onto a recording medium while controlling each of the nozzle groups according to the determined printing workload share.

The printing workload share determining may differentially determine the printing workload share for each of the nozzle groups when the nozzle groups have a different number of defective nozzles that are determined to be defective as a result of the inquiring.

The foregoing and other objects of the present invention may also be achieved by providing a method of compensating for deteriorated nozzles of an inkjet printer, including determining a presence of a printing workload share adjusting mode; printing a test pattern onto a recording medium when the printing workload share adjusting mode is determined; adjusting a printing workload share of each of a plurality of nozzle groups with respect to an image writing unit area when a serial number of a defective nozzle of the nozzle groups is input based upon the test pattern, such that the nozzle group having a defective one of the nozzles corresponding to the input serial number has a lower printing workload share than other ones of the nozzle groups; and printing image data onto the recording medium while controlling the nozzle groups according to the adjusted printing workload share.

The test pattern printing may print a test mark of a certain shape onto the recording medium, together with the serial number of the nozzle that printed the test mark, enabling the user to determine the acceptability of print quality.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
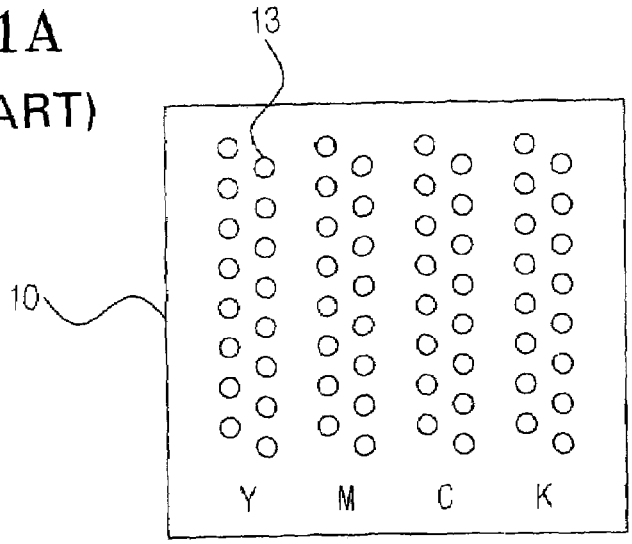
FIG. 1A (PRIOR ART)
FIGS. 1A and 1B are views showing a print head of a conventional inkjet printer.
Figure 1B:
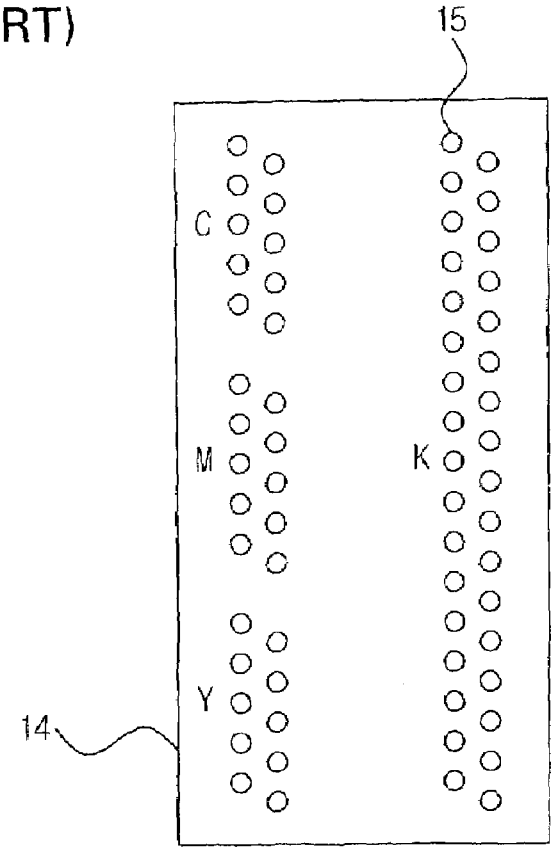
FIG. 1B (PRIOR ART)

Reference will now be made in detail to the present preferred embodiments of the present invention, examples of which are illustrated in the accompanying drawings, wherein like reference numerals refer to like elements throughout.

Figure 2:
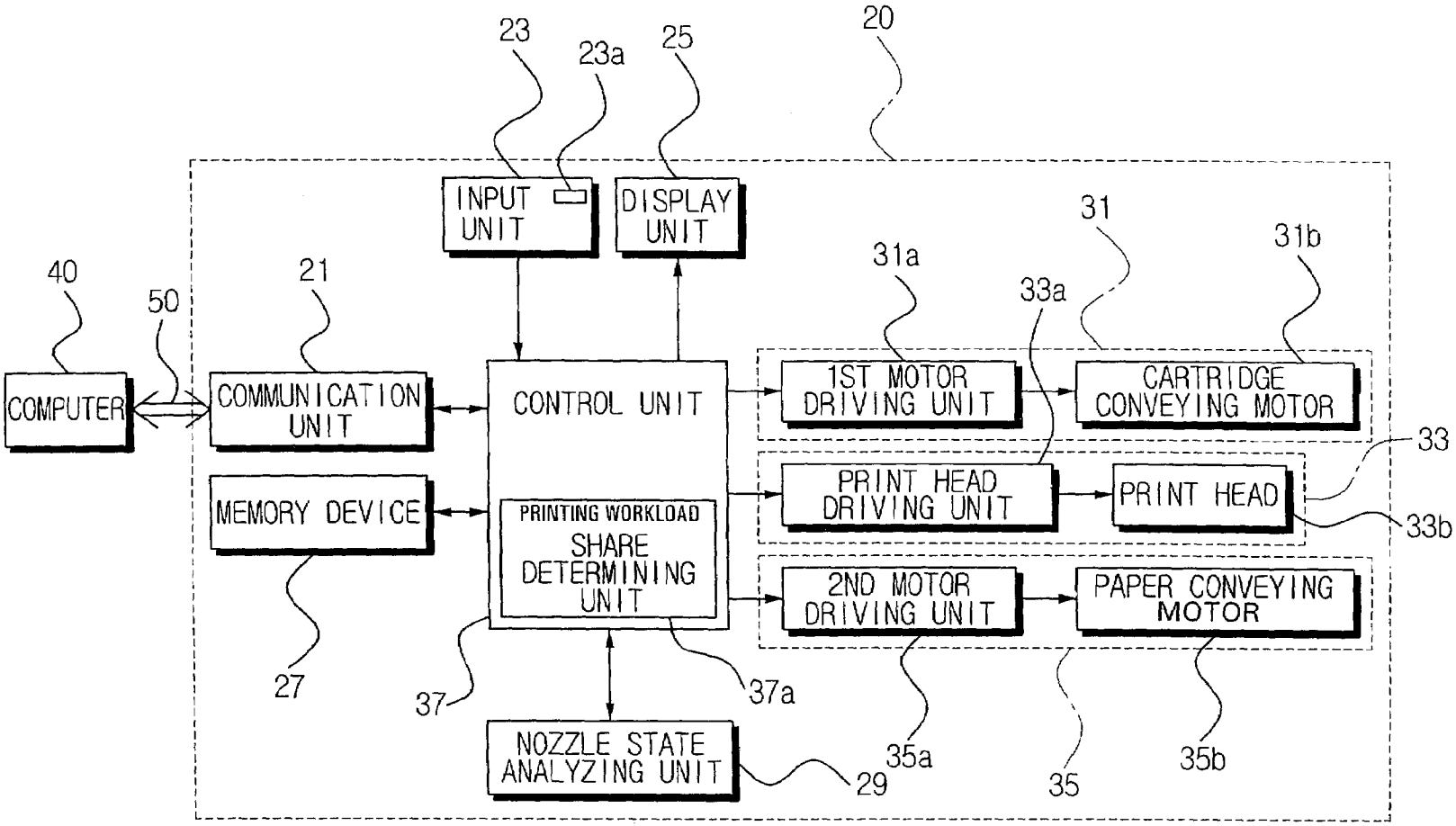
FIG. 2 is a block diagram showing an inkjet printing system according to an embodiment of the present invention.

FIG. 2 is a block diagram showing an inkjet printer according to the present invention. Referring to FIG. 2, an inkjet printer 20 is connected to a computer 40 via a communication interface 50. The inkjet printer 20 includes a communication unit 21, an input unit 23, a display unit 25, a memory device 27, a nozzle state analyzing unit 29, a cartridge conveying unit 31, a print head unit 33, a paper conveying unit 35 and a control unit 37.

The communication unit 21 receives data from the computer 40 through the communication interface 50, and transmits data to be transmitted to the computer 40 through the communication interface 50. Various forms of devices, namely, a scanner (not shown), can be externally connected to the inkjet printer 20 through the communication interface 50 to output print data.

The input unit 23 has a key 23*a* for a user to select various print functions being supported by the printer. The input unit 23 may have a printing workload share adjusting mode execution key to automatically adjust the printing workload share for each nozzle group. Alternatively, the input unit 23 can have a printing workload share selection key to select a printing workload share for each nozzle group according to an input by a user. The display unit 25 displays display information under the control of the control unit 37.

The memory device 27 stores various programs to operate the inkjet printer 20. The memory device 27 may store masking tables corresponding to the printing workload shares. The masking tables may correspond to a driving pattern of the nozzles to which the printing workload is assigned according to the selected printing workload shares for each of the nozzle groups. Also, masking tables correspond to the pixel location information by which the nozzles share printing workload with each other for the pixels that constitute the printing area. The memory device 27 also stores test pattern print data, for a user to determine whether the nozzles are defective or not.

Under the control of the control unit 37, the memory device 27 is also used to temporarily store the print data received through the communication unit 21 and to convert the temporarily stored print data into data to drive nozzles. The memory device 27 includes a read-only memory (ROM), a random-access memory (RAM) and/or a hard disk.

The nozzle state analyzing unit 29 diagnoses the state of the nozzles under the control of the control unit 37 and sends the result of the diagnosis to the control unit 37. As an example, the nozzle state analyzing unit 29 can determine a normal/abnormal status of the nozzle from a comparison between a reference value and the electric current flowing from a print head driving unit 33*a* into a switch element. In this case, the print head driving unit 33*a* controls ink ejection through each nozzle, and the switch element switches each nozzle on/off. Other examples may be found in Korean Patent Nos. 99-20082, 99-38206, 98-40823 and Korean Utility Model No. 99-10870.

Alternatively, the nozzle state analyzing unit 29 can be formed such that the test marks are printed onto the recording medium differently according to each nozzle or nozzle group, with a scanner being employed to determine the printing state of the printed test mark. For example, Korean Patent No. 99-58137 discloses an example of such a nozzle state analyzing unit 29. The nozzle state analyzing unit 29 can also be constructed in a simple structure in which a light is projected from a light source onto the recording medium, on which the test mark is printed, and the nozzle state analyzing unit 29 receives a reflected light from the recording medium and outputs a signal corresponding to the shape of the test mark.

The cartridge conveying unit 31 is disposed to move an ink receptacle (not shown) and a cartridge (not shown), on which the print head 33*b* is mounted, across the advancing direction of the paper. The cartridge conveying unit 31 has a cartridge conveying motor 31*b* to convey the cartridge and a first motor driving unit 31*a* to control the cartridge conveying motor 31*b* under the control of the control unit 37.

The print head unit 33 has a print head 33*b* to discharge the ink from the ink receptacle through a plurality of nozzles, and a print head driving unit 33*a* to drive the print head 33*b*.

The paper conveying unit 35 picks up the paper from a paper stack in a paper stack unit (not shown) and is conveyed along a printing path. The paper conveying unit 35 includes a paper conveying motor 35*b* to convey the paper, and a second motor driving unit 35*a* to control the driving of the paper conveying motor 35*b*.

The control unit 37 processes the signals received through the input unit 23 and the signals received through the communication interface 50. Also, the control unit 37 controls corresponding elements so that the data received through the communication unit 21 can be printed on the paper according to predetermined setup information.

The control unit 37 has a nozzle group printing workload share determination unit 37*a* to selectively determine a printing workload share for the nozzle groups, including a plurality of the nozzles, with respect to a predetermined image writing unit area.

The nozzle group printing workload share determination unit 37*a* is provided with a printing workload share application table or an operation program to be applied according to the relative number of the defective nozzles of the nozzle groups.

The nozzle group printing workload determination unit 37*a* can also be constructed to determine a driving pattern for the nozzles of the nozzle groups of the print head 33*b* according to the printing workload share that is selected for each nozzle group through the input unit 23.

Alternatively, the nozzle group printing workload share determination unit 37*a* can be constructed to determine the printing driving pattern for the nozzles of each nozzle group of the print head 33*b* according to the information about the defective nozzles inputted through the input unit 23. That is, the printing workload share for each nozzle group is determined as the numbers of the defective nozzles are input through the input unit 23. The printing workload share determination unit 37*a* uses the input information to determine a relative printing workload share for each nozzle group according to the differences between the number of the defective nozzles in the respective nozzle groups.

Alternatively, the nozzle state analyzing unit 29 can be controlled to analyze the presence of defective nozzles so that the printing workload share for each nozzle group can be determined according to the proportion of the defective nozzles in each nozzle group.

Among the pixels corresponding to the lines that are assigned to each nozzle according to the determined printing workload share, the nozzle group printing workload share determination unit 37*a* determines information about locations of pixels that are assigned to each nozzle for printing. Also, the control unit 37 controls the print head driving unit 33*a* so that the nozzles corresponding to the pixels of the pixel location information, which corresponds to the determined printing workload share for the nozzle groups, can be driven according to the printing data information, while the cartridge is moved across the paper advancing direction.

Meanwhile, it is also possible that a user is able to select a desired printing workload share for each nozzle group through the input unit 23 of the printer 20, or alternatively, a printer driver installed in the computer 40 can be provided with a menu to execute analysis of the state of the nozzles and make automatic adjustments to the print workload share accordingly.

Figure 3:
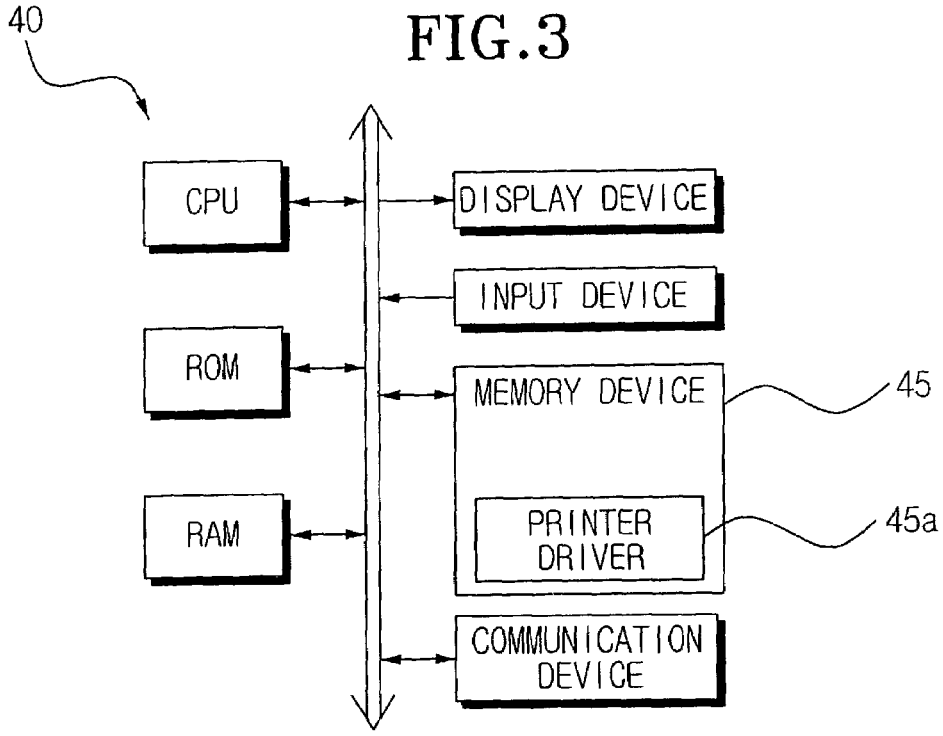
FIG. 3 is a block diagram showing the computer of FIG. 2 in greater detail.

More specifically, a printer driver 45*a* installed in a memory device 45 of the general computer (FIG. 3) can adjust the printing workload share for each nozzle group. In this case, the printer driver 45*a* provides menus to adjust the printing workload share for each nozzle group, and to transmit to the inkjet printer 20 the information about the selection made by the user through the menu so that the inkjet printer 20 adjusts the printing workload share for each nozzle group.

The respective printing patterns of the nozzles according to the printing workload shares for the nozzle groups will be described below with reference to FIGS. 8 through 10. The number and color of the nozzles arranged on the print head 33*b* can be different according to each product.

Figure 4A:
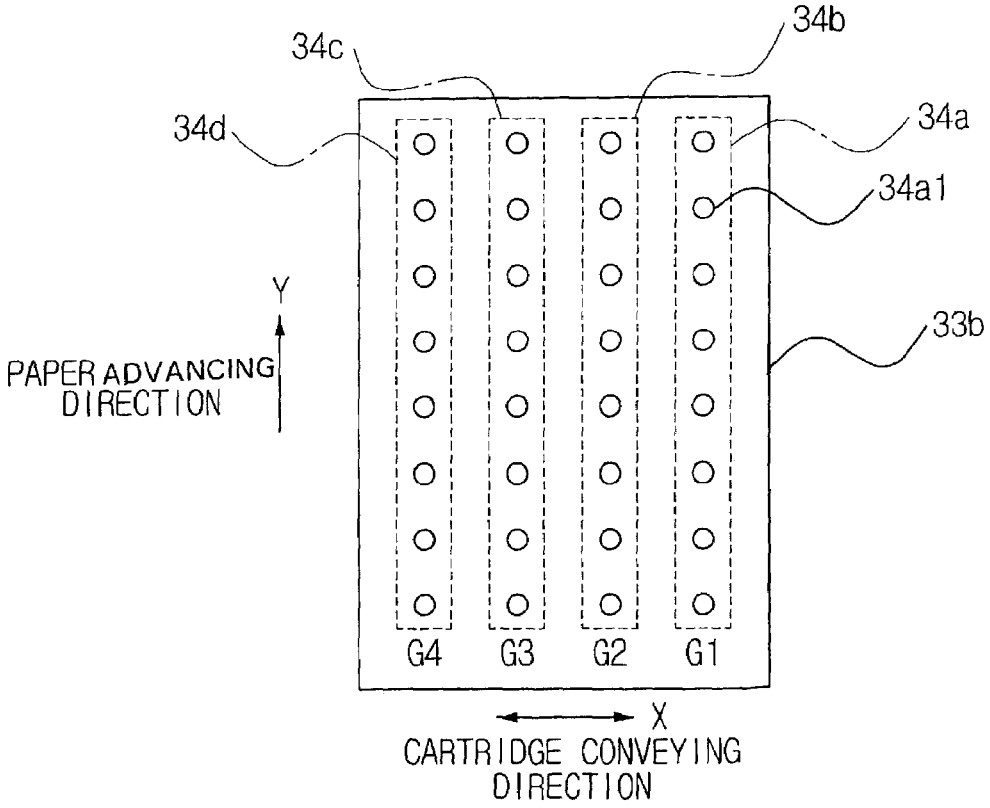
FIG. 4A is a view showing one example of the print head of FIG. 2.

For ease of explanation, it will be assumed that there are four nozzle groups (34*a*–34*d*; G1–G4) provided on the printer head 33*b*, each including eight nozzles arranged in a row along a paper advancing direction (Y) (see FIG. 4A). It is also assumed that, in one scanning movement of the cartridge across the paper advancing direction and in a direction of cartridge conveyance (X), the cartridge is set to print eight lines, with the nozzles in the same row being assigned for the printing of one line. The nozzle driving pattern is determined such that four of the first nozzles of the respective nozzle groups (34*a*–34*d*) in cooperation perform printing of the first line of eight lines, and four of the second nozzles of the respective nozzle groups (34*a*–34*d*) in cooperation perform printing of the second line of the eight lines.

The following description is about the exemplary case in which the respective nozzle groups (34*a*–34*d*) are assigned with printing workloads of 33%, 33%, 17% and 17%, respectively.

First, a pattern of driving the nozzles is determined such that the nozzles of the first nozzle group 34*a* are assigned to every first one of the three pixels for the assigned line.

Figure 8A:
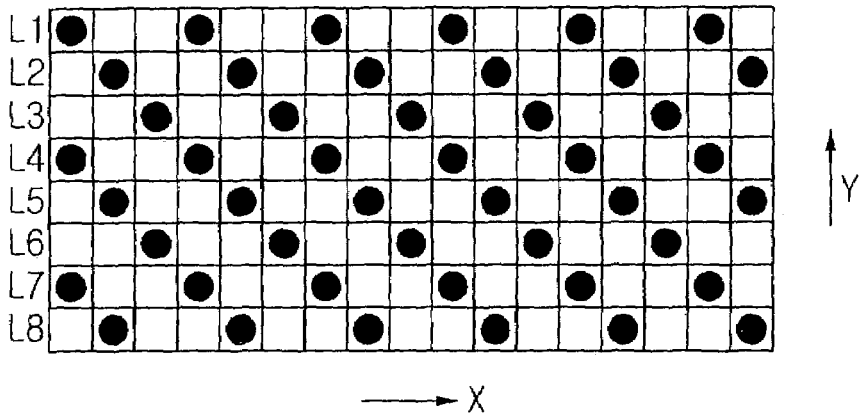
FIG. 8A is a view showing locations of the pixels assigned for printing on an image writing area when 33% of the printing workload is selected for the first nozzle group of FIG. 4A.

FIG. 8A shows the driving pattern of the nozzles of the first nozzle group 34*a* that correspond to the location of the pixels. Here, one pixel represents one unit of printing area. Dark dots in FIG. 8A indicate the printing locations of the respective nozzles of the first nozzle group 34*a*, while L1 through L8 indicate the lines to be printed. The nozzles of the first nozzle group 34*a* are assigned for the printing of the corresponding print line according to the determined printing workload share. In other words, the first nozzle of the first nozzle group 34*a* is assigned for the printing of the first printing line L1 with respect to every first one of the three pixels, while the second nozzle 34*a*1 of the first nozzle group 34*a* is assigned for the printing of the second printing line L2 with respect to every first one of the three pixels.

Figure 8B:
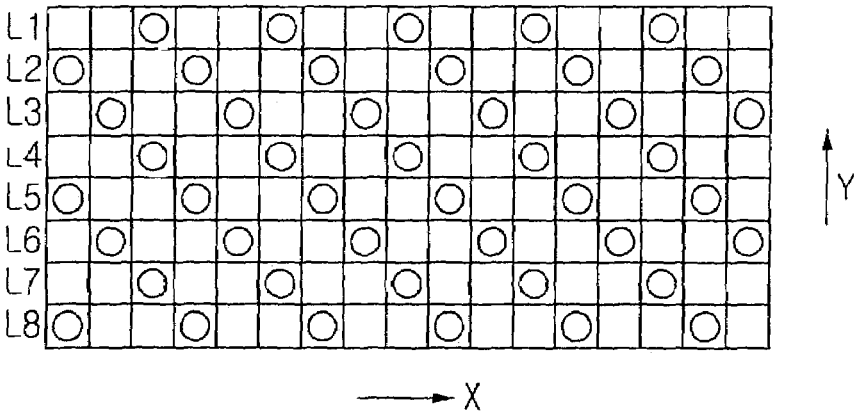
FIG. 8B is a view showing locations of the pixels assigned for printing on an image writing area when 33% of the printing workload is selected for the second nozzle group of FIG. 4A.

Likewise, the nozzles of the second nozzle group 34*b* are assigned for the remaining areas other than the area occupied by the nozzles of the first nozzle group 34*a*, for every first one of the three pixels of the respective lines, where the pixels are at a constant interval (see FIG. 8B).

Figure 8C:
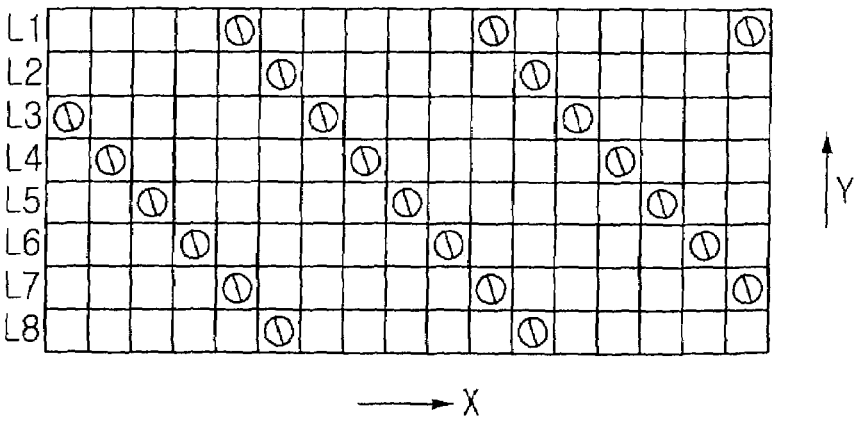
FIG. 8C is a view showing locations of the pixels assigned for printing on an image writing area when 17% of the printing workload is selected for the third nozzle group of FIG. 4A.
Figure 8D:
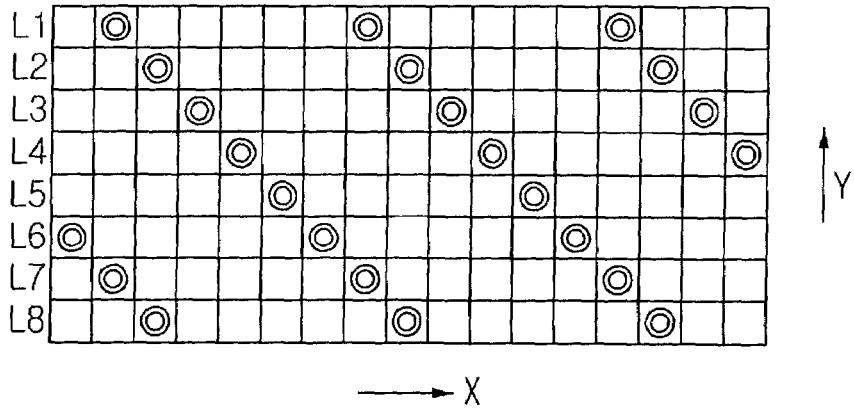
FIG. 8D is a view showing locations of the pixels assigned for printing on an image writing area when 17% of the printing workload is selected for the fourth nozzle group of FIG. 4A.
Figure 8E:
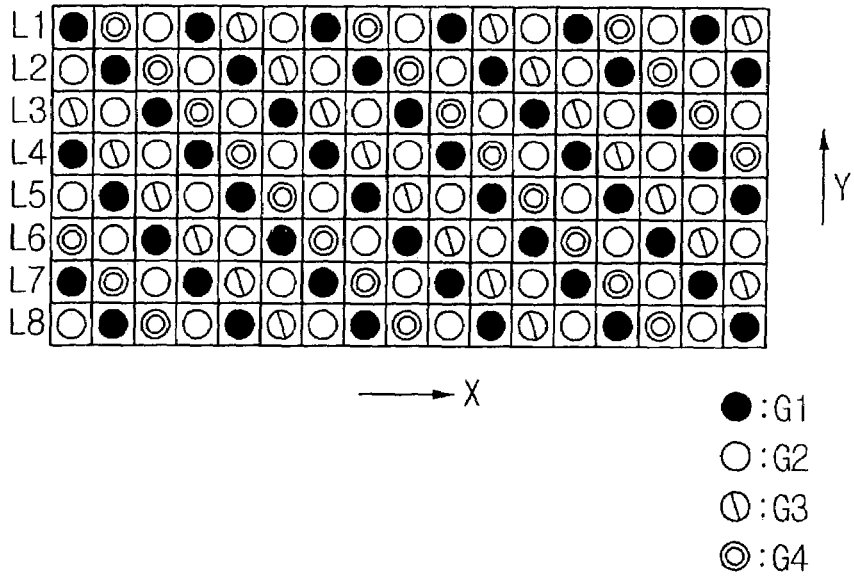
FIG. 8E is a view showing locations of the pixels assigned for printing on an image writing area relative to all of the nozzle groups, according to printing workload shares given to the respective nozzle groups as shown in FIGS. 8A through 8D.

The driving pattern for the nozzles of the third nozzle group 34*c* is determined such that the nozzles are assigned for the areas other than the areas occupied by the first and second nozzle groups 34*a* and 34*b*, for every first one of the six pixels as shown in FIG. 8C. The driving pattern for the nozzles of the fourth nozzle group 34*d* is determined such that the nozzles are assigned for every first one of the six pixels as shown in FIG. 8D. FIG. 8E shows the driving patterns of the nozzle groups 34*a*–34*d* with respect to the printing areas. Accordingly, when the nozzle groups 34*a*–34*d* are assigned with 33%, 33%, 17% and 17% of printing workload shares, respectively, the nozzle driving pattern shown in FIG. 8E is applied to the overall image writing area in the cartridge conveying direction and the paper conveying direction.

In another example, the nozzle groups 34*a*–34*d* are assigned with 12%, 25%, 25% and 38% of the printing workload. The location of the pixels for printing corresponding to each nozzle group is shown in FIGS. 9A through 9D.

Figure 9A:
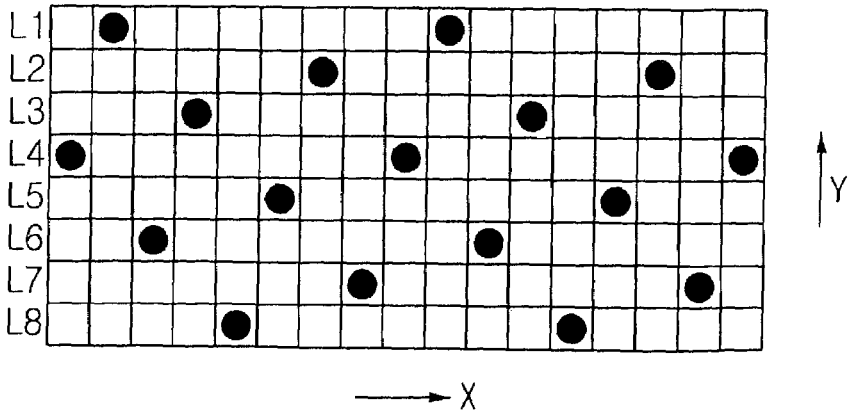
FIG. 9A is a view showing locations of the pixels assigned for printing on an image writing area according to a second embodiment of the present invention when 12% of the printing workload is selected for the first nozzle group of FIG. 4A.
Figure 10A:
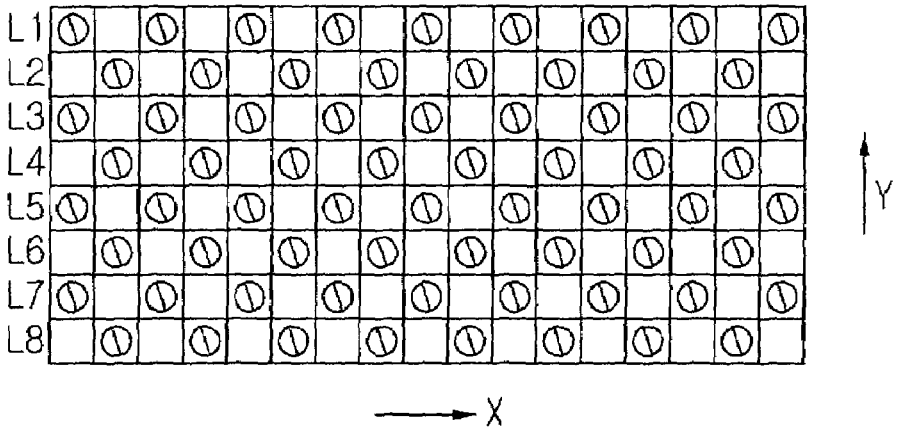
FIG. 10A is a view showing locations of the pixels assigned for printing on an image writing area according to a third embodiment of the present invention, when 50% of the printing workload is selected for the third nozzle group of FIG. 4A.
Figure 10B:
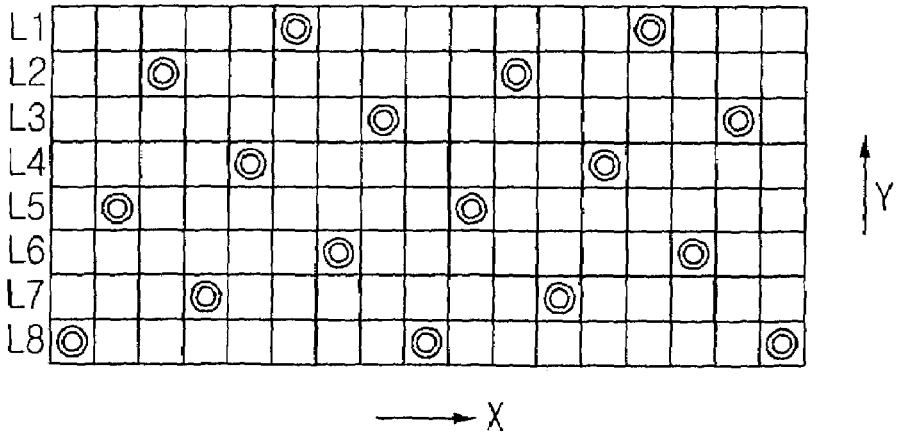
FIG. 10B is a view showing locations of the pixels assigned for printing on an image writing area according to the third embodiment of the present invention, when 12% of the printing workload share is selected for the fourth nozzle group of FIG. 4A.

As shown in FIG. 9A, the driving pattern is determined for the first nozzle group 34*a* such that the nozzles are assigned for every first pixel of the eight pixels that are arranged along a corresponding line.

Figure 9B:
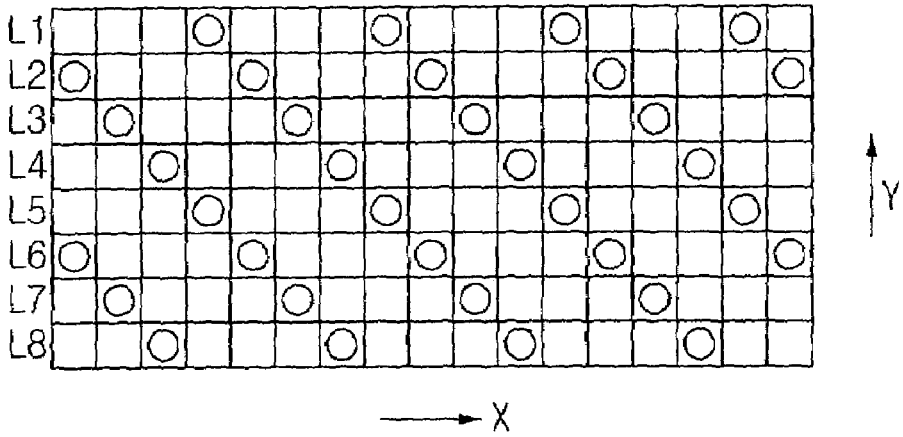
FIG. 9B is a view showing locations of the pixels assigned for printing on an image writing area according to the second embodiment of the present invention when 25% of the printing workload is selected for the second nozzle group of FIG. 4A.
Figure 9C:
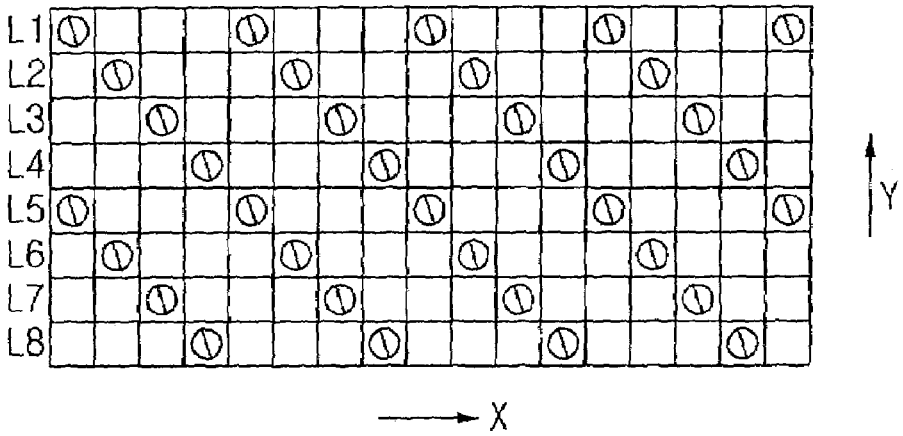
FIG. 9C is a view showing locations of the pixels assigned for printing on an image writing area according to the second embodiment of the present invention, when 25% of the printing workload is selected for the third nozzle group of FIG. 4A.
Figure 9D:
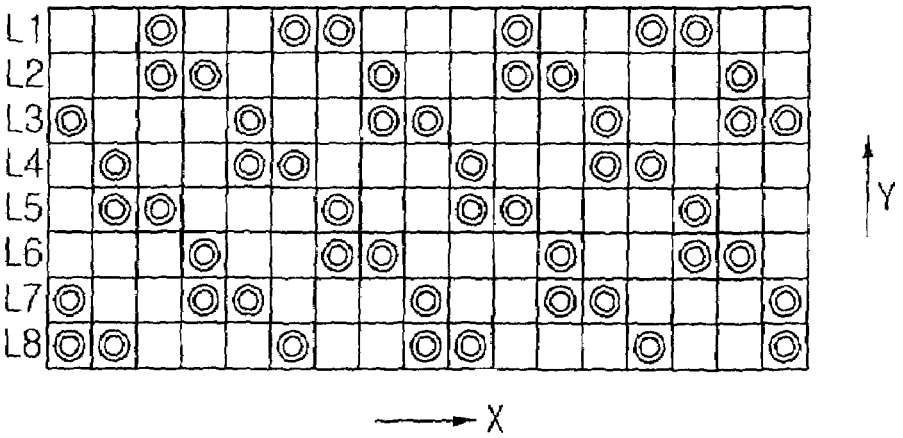
FIG. 9D is a view showing locations of the pixels assigned for printing on an image writing area according to the second embodiment of the present invention, when 38% of the printing workload is selected for the fourth nozzle group of FIG. 4A.
Figure 9E:
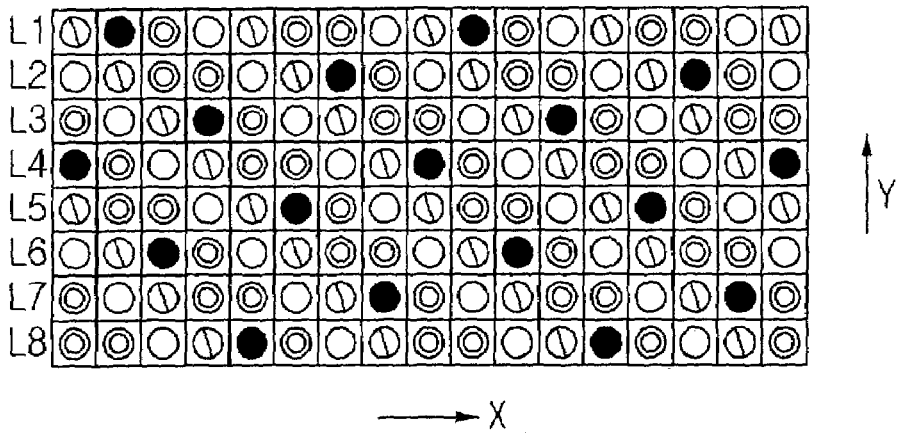
FIG. 9E is a view showing locations of the pixels assigned for printing on an image writing area relative to all of the nozzle groups, according to the printing workload shares as shown in FIGS. 9A through 9D.

FIGS. 9B and 9C show the driving patterns of the second and third nozzle groups 34*b* and 34*c*, under which the respective nozzles are assigned for every first pixel of the four pixels arranged along the corresponding line. FIG. 9D shows the driving pattern for the fourth nozzle group 34*d*, under which the respective nozzles are assigned for three out of eight pixels. FIG. 9E shows the combination of driving patterns of the respective nozzle groups 34*a*–34*d* with respect to the image writing area.

Figure 10C:
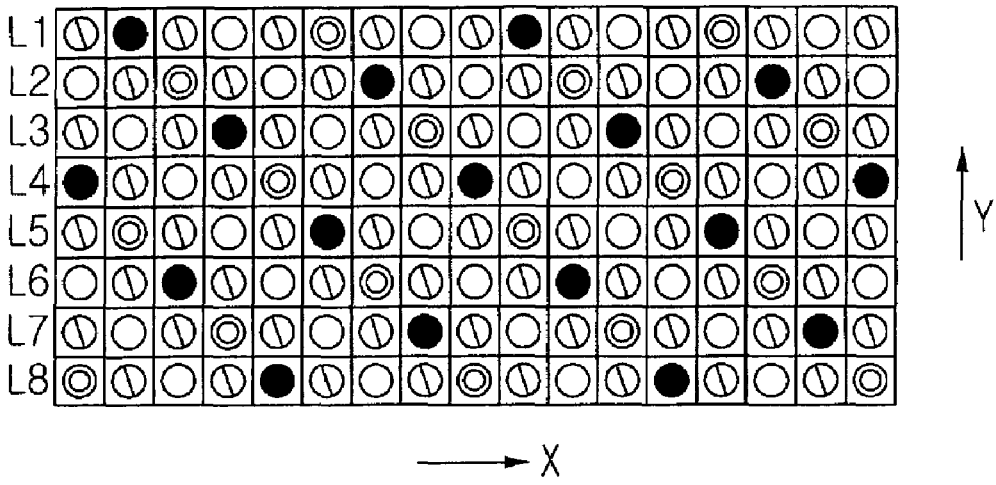
FIG. 10C is a view showing locations of the pixels assigned for printing on an image writing area relative to all of the nozzle groups according to the third embodiment of the present invention, according to the printing workload determined for the respective nozzle groups.

According to still another example, the nozzle groups 34*a*–34*d* are assigned with 12%, 25%, 50% and 12% of the printing workload, respectively. In this case, the first nozzle group will be applied with the driving pattern of FIG. 9A, the second nozzle group 34*b* with the driving pattern of FIG. 9B, and the third and the fourth nozzle groups 34*c* and 34*d* with the driving patterns of FIGS. 10A and 10B, respectively. As a result, the overall driving patterns of the respective nozzle groups 34*a*–34*d* are shown in FIG. 10C.

As described above, the nozzle group with relatively more defective nozzles is assigned with a relatively lower printing workload, while the nozzle group with relatively less defective nozzles is assigned with a relatively higher printing workload. By driving the nozzles according to such determined printing workloads for each nozzle group, the print quality deterioration can be effectively prevented.

Figure 4B:
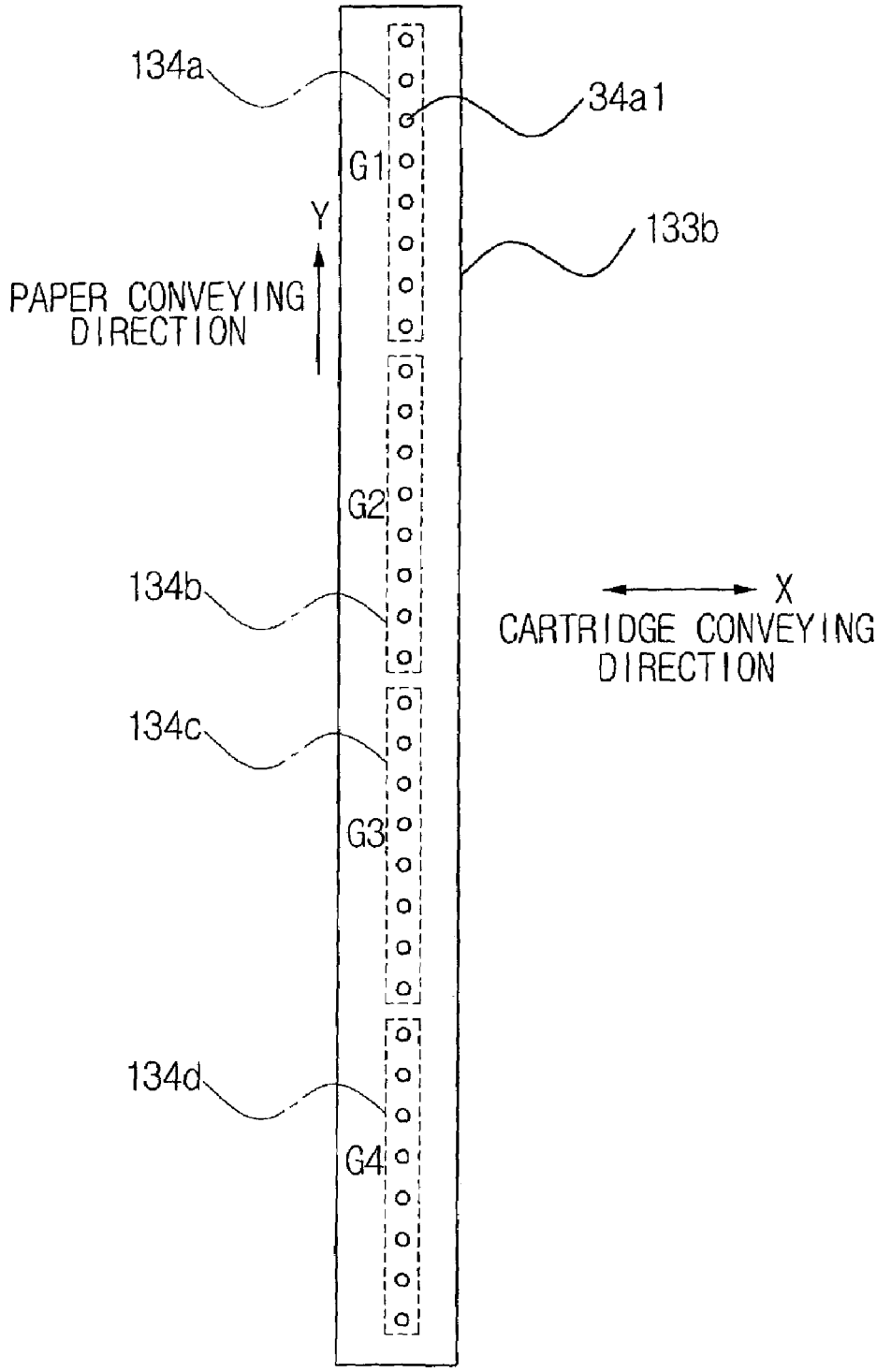
FIG. 4B is a view showing another example of the print head of FIG. 2.

Meanwhile, in the case of the print head 133*b* of FIG. 4B, which is arranged in a row along the paper conveying direction, nozzles are driven sequentially in accordance with the above-described method at the time when the image writing unit area of the paper enters the location that corresponds to the respective nozzle groups 134*a* ~134*d*.

Figure 5:
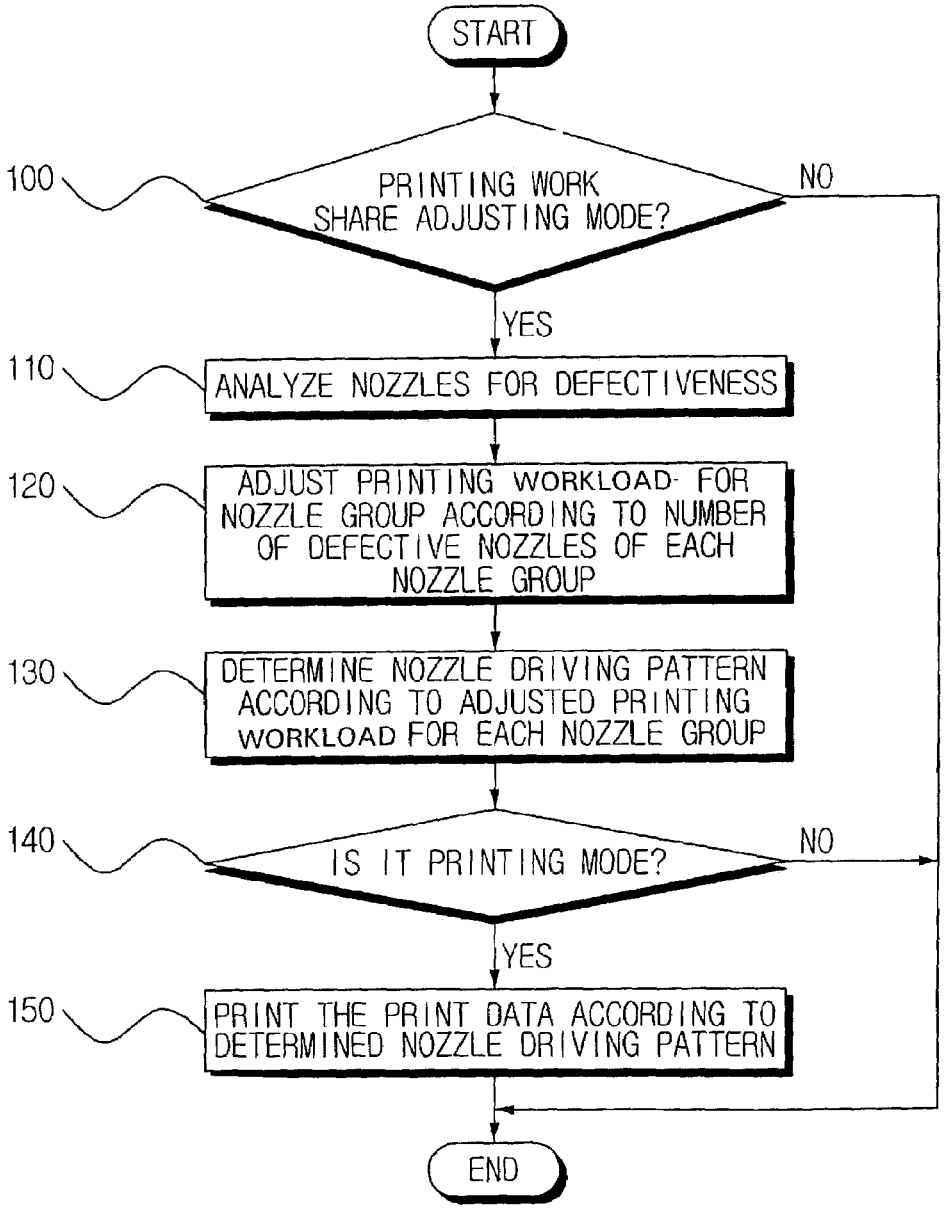
FIG. 5 is a flowchart showing a process of compensating for deteriorated nozzles according to a first embodiment of the present invention.
Figure 6:
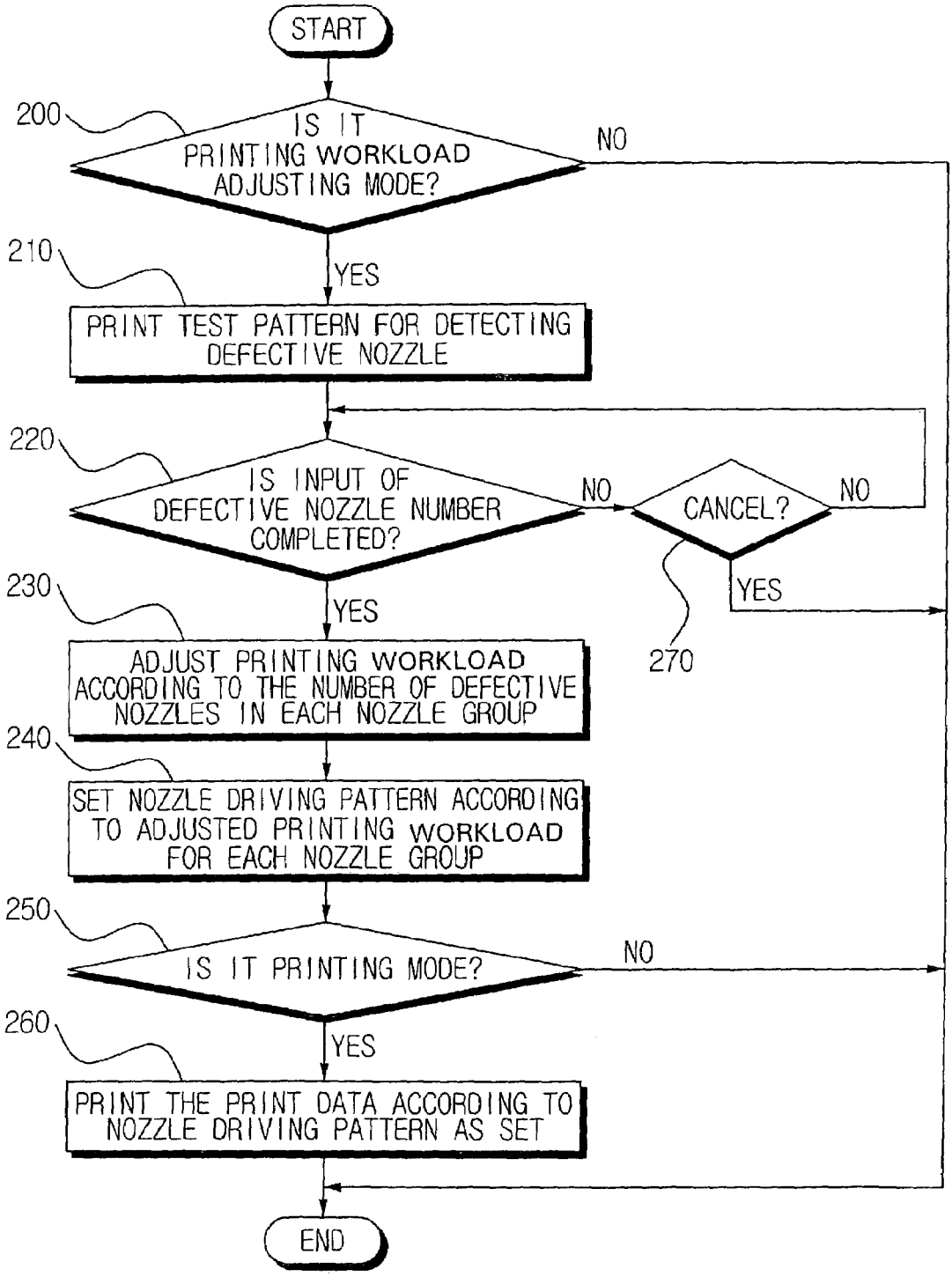
FIG. 6 is a flowchart showing the process of compensating for deteriorated nozzles according to a second embodiment of the present invention.

FIGS. 5 and 6 illustrate a process of determining the printing workload share for each nozzle group.

First, the control unit 37 determines whether the system is in a printing workload share adjusting mode (100).

When either the input unit 23 or the printer driver 45*a* has the printing workload share adjusting mode execution key, the control unit 37 determines the defective nozzle compensating mode upon receipt of a signal when the key is pressed. Alternately, the printing workload share adjusting mode can be performed when the number of printed sheets reaches a predetermined value, for example, 1000 sheets.

When the printing workload share adjusting mode is determined, the nozzle state analyzing unit 29 is driven to analyze whether there is a defective nozzle (110).

Next, by counting the number of detected defective nozzles in each nozzle group, the printing workload for each nozzle group is adjusted (120). For example, there is one defective nozzle in the first nozzle group, one defective nozzle in the second nozzle group, three defective nozzles in the third nozzle group, and three defective nozzles in the fourth nozzle group. In such a case, the printing workload share of the nozzle groups is 33%, 33%, 17% and 17%, respectively, under the driving pattern as shown in FIG. 8E (130).

Likewise, if there are three, two, two and one defective nozzle(s) in the first, second, third and the fourth nozzle groups, respectively, the printing workload share is 12%, 25%, 25% and 38%, respectively, under the driving pattern as shown in FIG. 9E.

As another example, if there are three, two, zero and three defective nozzles in the first, second, third and the fourth nozzle groups, respectively, the printing workload share is 12%, 25%, 50% and 12%, under the driving pattern as shown in FIG. 10C.

Although certain printing workload shares are described above by way of examples, to those skilled in the art, it would be appreciated that the printing workload shares for each of the nozzle groups could vary according to the proportions of the defective nozzles of the nozzle groups.

When the printing mode is determined, after the printing workload share of each nozzle group is determined (140), the printing is performed according to the nozzle driving pattern that corresponds to the determined printing workload share for each nozzle group (150).

FIG. 6 shows another example in which the user can determine the presence of defective nozzles, and input information about the detected defective nozzles. First, it is determined whether the printing workload share adjusting mode is in effect or not (200).

Figure 7:
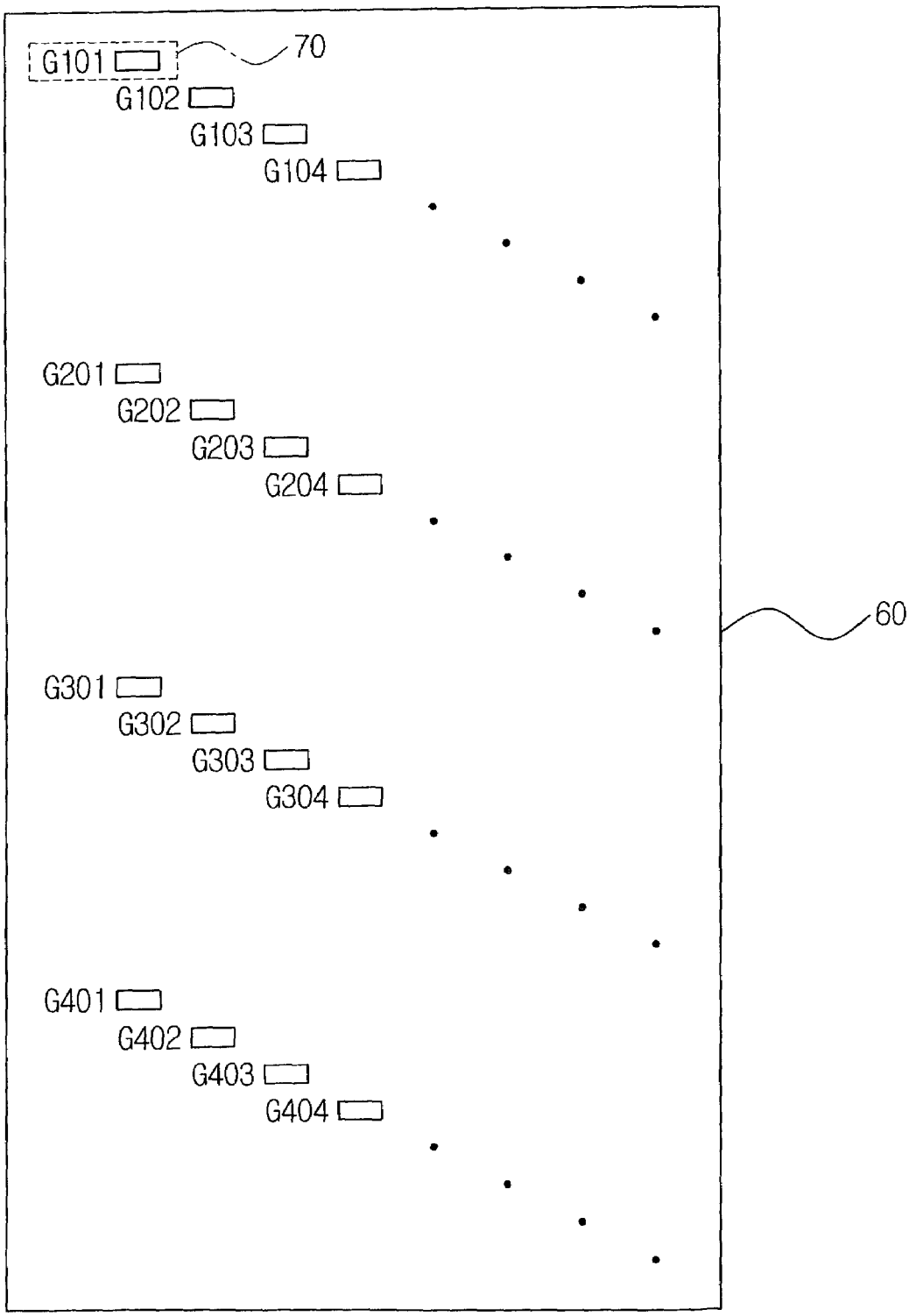
FIG. 7 is a view showing one example of a test pattern according to the present invention.

If the printing workload share adjusting mode is detected, the test pattern to determine the defective nozzles is printed on the paper (210). The test pattern may be formed such that test marks are formed at a predetermined interval from one another, with serial numbers of the nozzles corresponding to the test marks being printed next to the test marks. As shown in FIG. 7, the test pattern 70 is applied in a manner such that each test mark is indicated with a corresponding identification serial number on the paper 60. The serial number in FIG. 7 has the letter 'G' followed by a numeral representing the number of the nozzle group and then another two-digit numeral representing the number of the nozzle. Taking the test mark indicated by 'G303' for example, this serial number indicates the test mark for the third nozzle of the third nozzle group.

After the test pattern 70 is printed, the user determines the acceptability of the test pattern for each nozzle by looking at the printed test pattern 70. If there is a test mark indicating a defective nozzle, the user inputs the corresponding serial number through the input unit 23 according to the defective nozzle inputting method supported by the control unit 37.

In operation 220, it is determined whether there has been input regarding the serial number of the defective nozzle. If a cancel menu is selected in the defective nozzle number inputting mode, the printing workload share adjusting mode is terminated.

When it is determined that the input of the serial number of the defective nozzle is completed, the printing workload share is adjusted by the printing workload share determining method described above, according to the number of the defective nozzles in each nozzle group (230).

Operations 240 through 260 are performed after the printing workload share adjusting mode is terminated. A description of operations 240 through 260 will not be repeated, as these operations have been discussed above with reference to FIG. 5.

Although in the above described embodiment, each test mark is printed for each nozzle, if it is too tiresome for a user to determine the individual defective nozzles, the test mark can also be printed for each nozzle group. In this case, each test mark is printed on the paper 60 together with a corresponding nozzle group number. The printer, or printer driver inputs the state of the defective nozzles according to the number of the defective nozzle group and/or the defect level of the defective nozzle group. Defect levels could be inputted as 'high,' 'intermediate' and 'low,' or by a percentage. The printing workload share may be determined for each nozzle group according to the user-input defect level of the defective nozzle groups.

Meanwhile, it is also possible that the printer is constructed such that the control unit automatically determines normality/abnormality of the nozzle through the printed test mark by using an image sensor.

The inkjet printer or printer driver 45*a* can also be constructed in a manner that enables a user to input and thus set the printing workload share for each nozzle, under the support of the input unit 23 or the printer driver 45*a*.

As described above, according to the inkjet printer and system and a method of compensating for the defective nozzle of the embodiment of present invention, since the printing workload share for defective nozzles, which are deteriorated by time, is decreased, the deterioration of print quality is prevented, without having to replace the print head.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An inkjet printer to print image data on an image writing unit area of a recording medium, the inkjet printer comprising:

a print head having a plurality of nozzles arrayed in nozzle groups to jet ink therethrough;

an input unit to select a printing workload share for each of the nozzle groups with respect to the image writing unit area, the nozzle groups each comprising a number of the plurality of the nozzles; and a control unit to control the print head according to the printing workload share selected by the input unit, thereby causing the image data to be printed onto the recording medium.

2. The inkjet printer of claim 1, further comprising a display device, wherein the input unit comprises a key to select the printing workload share, and when the key is selected, the control unit displays a printing workload share selection menu on the display device, to select the printing workload share for each of the nozzle groups through a manipulation of the input unit.

3. The inkjet printer of claim 2, wherein the printing workload share selection menu provides selections of 12%, 17%, 25%, 38% or 50% of the printing workload share for each of the nozzle groups.

4. The inkjet printer of claim 3, wherein the printing workload share selection menu provides selections of 0% and 100% of the printing workload share.

5. The inkjet printer of claim 3, wherein the control unit comprises a masking table of each of the printing workload shares, the masking table corresponding to information about a printing position where the nozzles of the nozzle groups selectively perform the printing of the image data with respect to the image writing unit area, and the control unit controls the nozzles to print the image data while applying the masking table that corresponds to the selected printing workload share for the nozzle groups.

6. The inkjet printer of claim 1, wherein each of the nozzle groups comprises a plurality of the nozzles that are arrayed in a row in an advancing direction of the recording medium, the nozzles being spaced from each other in the advancing direction of the recording medium.

7. An inkjet printer to print image data on an image writing unit area of a recording medium, the inkjet printer comprising:

a print head having a plurality of nozzles arrayed in nozzle groups to jet ink therethrough;

an input unit comprising a printing workload share adjusting mode key to inquire about a presence of a defective one of the nozzles in the nozzle groups and to adjust a printing workload share for the nozzle groups according to a checking result in the image writing unit area;

a nozzle state analyzing unit to analyze the defective one of the nozzles; and a control unit to control the nozzle state analyzing unit to analyze the presence of the defective nozzle when the printing workload share adjusting mode key is selected, the control unit to adjust the printing workload share of the nozzle groups so that one of the nozzle groups having a greater number of the defective nozzles has a lower printing workload share than another one of the nozzle groups in regard to the image writing unit area, the control unit to control the print head according to the adjusted printing workload share when the image data is printed on the recording medium.

8. The inkjet printer of claim 7, wherein the control unit adjusts the, printing workload share of the nozzle groups by analyzing information about a state of the nozzles which is output by the nozzle state analyzing unit, such that a one of the nozzle groups having the most defective nozzles has a lower printing workload share than one of the nozzle groups having the least defective nozzles.

9. An inkjet printing system comprising:

a print head having a plurality of nozzles arranged in nozzle groups to jet ink therethrough;

an inkjet printer that prints image data onto a recording medium by controlling the print head; and a computer connected to the inkjet printer, the computer comprising a printer driver to provide a menu to variably select a printing workload share for each of the nozzle groups, and to transmit the information about the selected printing workload share of the nozzle groups to the inkjet printer such that the print head is driven according to the selected printing workload share.

10. A method of compensating for deteriorated nozzles of an inkjet printer, comprising:

inquiring about a presence of defectiveness in a plurality of nozzles that jet an ink therethrough, the nozzles arranged in nozzle groups;

determining a printing workload share for each of the nozzle groups according to relative proportions of the defective nozzles in the nozzle groups; and printing onto a recording medium while controlling each of the nozzle groups according to the determined printing workload share.

11. The method of compensating for deteriorated nozzles of claim 10, wherein the printing workload share differentially determines the printing workload share for the nozzle groups when the nozzle groups have different numbers of the defective nozzles.

12. A method of compensating for deteriorated nozzles of an inkjet printer, comprising:

determining a presence of a printing workload share adjusting mode;

printing a test pattern onto a recording medium when the printing workload share adjusting mode is determined;

adjusting a printing workload share of each of a plurality of nozzle groups with respect to an image writing unit area when a serial number of a defective nozzle of the nozzle groups is input based upon the test pattern, such that one of the nozzle groups having the defective nozzle corresponding to the input serial number has a lower printing workload share than other ones of the nozzle groups; and printing image data onto the recording medium while controlling the nozzle groups according to the adjusted printing workload share.

13. The method of compensating for deteriorated nozzles of claim 12, wherein the printing of the test pattern comprises printing a test mark of a certain shape onto the recording medium, and the serial number of the nozzle that printed the test mark next to the test mark, so that a user can determine whether the nozzle corresponding to the test mark has an acceptable print quality.

14. The method of compensating for deteriorated nozzles of claim 12, wherein the printing of the test pattern comprises printing a test mark of a certain shape onto the recording medium and the serial number of the nozzle group that printed the test mark next to the test mark, so that a user can determine whether the nozzle corresponding to the test mark has an acceptable print quality.

15. An apparatus to print data on a recording medium, the apparatus comprising:

a head having a plurality of nozzles arrayed in nozzle groups to print the data, a printing workload share for each of the nozzle groups being based on relative proportions of deteriorated nozzles in the nozzle groups.

16. An apparatus to print data on a recording medium, the apparatus comprising:

a print head having a plurality of nozzles arrayed in nozzle groups to print the data;

a first determination unit to determine a deteriorated status of the nozzles; and a second determination unit to determine a printing workload share for each of the nozzle groups based on the status determined by the first determination unit, each of the printing workload shares being less than or equal to 100% of a total workload, wherein the second determination unit determines the printing workload share based on relative proportions of the deteriorated nozzles in the nozzle groups.

17. The apparatus of claim 16, further comprising:

a print head driving unit to control an ejection of ink through the nozzles to print the data and a switch to switch the nozzles on/off, wherein the first determination unit determines the deteriorated status of the nozzles based on a current flowing from the print head driving unit to the switch.

18. The apparatus of claim 16, wherein the nozzles print test marks, and the first determination unit is a scanner to scan the test marks to determine the deteriorated status of the nozzles.

19. The apparatus of claim 16, wherein the nozzles print test marks, and the first determination unit projects light on the test marks and analyzes a reflection of the projected light from the test marks to determine the deteriorated status of the nozzles.

20. The apparatus of claim 16, wherein the nozzle groups are arranged along a direction of advancing the recording medium.

21. The apparatus of claim 16, wherein the nozzle groups are arranged across a direction of advancing the recording medium.

22. The apparatus of claim 16, wherein the printed data comprises pixels, and the nozzles alternate printing the pixels according to the respective printing workload shares.

23. An apparatus to print data on a recording medium, the apparatus comprising:

a print head having a plurality of nozzles arrayed in nozzle groups to print the data;

a first determination unit to determine a deteriorated status of the nozzles;

a second determination unit to determine a printing workload share for each of the nozzle groups based on the status determined by the first determination unit; and an input key to automatically adjust the printing workload share based on an input from a user.

24. An apparatus to print data on a recording medium, the apparatus comprising:

a print head having a plurality of nozzles arrayed in nozzle groups to print the data;

a first determination unit to determine a deteriorated status of the nozzles; and a second determination unit to determine a printing workload share for each of the nozzle groups based on the status determined by the first determination unit, wherein the second determination unit determines the printing workload share based upon differences between numbers of the defective nozzles in the nozzle groups.

25. A method of printing data on a recording medium, the method comprising:

ejecting ink through a plurality of nozzles arrayed in nozzle groups;

determining a deteriorated status of the nozzles; and determining a printing workload share for each of the nozzle groups based on the determining of the deteriorated status, comprising determining the printing workload share based on relative proportions of the deteriorated nozzles in the nozzle groups.

* * * * *

UNITED STATES PATENT AND TRADEMARK OFFICE

CERTIFICATE OF CORRECTION

PATENT NO. : 7,021,734 B2
APPLICATION NO. : 10/345939
DATED : April 4, 2006
INVENTOR(S) : Seung-don Lee It is certified that error appears in the above-identified patent and that said Letters Patent is hereby corrected as shown below:

Column 11, Line 51 change “the,” to --the--.

Column 13, Line 8 after “data” insert --;--.

Signed and Sealed this

Fifth Day of December, 2006

JON W. DUDAS
*Director of the United States Patent and Trademark Office*